US006484407B2

(12) United States Patent
Khatchadourian et al.

(10) Patent No.: US 6,484,407 B2
(45) Date of Patent: Nov. 26, 2002

(54) FOOD CUTTING UTENSIL

(75) Inventors: Puzant Khatchadourian, 100 United Nations Plz., 327 E. 48th St., Apt. 38A, New York, NY (US) 10017; Edward Czajka, Brooklyn, NY (US)

(73) Assignee: Puzant Khatchadourian, New York, NY (US)

( * ) Notice: Subject to any disclaimer, the term of this patent is extended or adjusted under 35 U.S.C. 154(b) by 0 days.

(21) Appl. No.: 09/808,870

(22) Filed: Mar. 15, 2001

(65) Prior Publication Data

US 2002/0129499 A1 Sep. 19, 2002

(51) Int. Cl.[7] ..... B26B 3/00

(52) U.S. Cl. ..... 30/319; 30/307; D7/694

(58) Field of Search ..... 30/292, 306, 307, 30/309, 319, 329, 334, 337, 338, 339; D7/694; 29/428, 525

(56) References Cited

U.S. PATENT DOCUMENTS

| | | | | | |
|---|---|---|---|---|---|
| 900,300 | A | * | 10/1908 | Nicolas | 30/319 |
| 3,262,205 | A | * | 7/1966 | Arden | 30/338 |
| 5,428,898 | A | * | 7/1995 | Hawkins | 30/319 |
| 5,555,625 | A | * | 9/1996 | Scheminger | 30/319 |
| D397,001 | S | * | 8/1998 | Antista et al. | D7/694 |

* cited by examiner

*Primary Examiner*—Hwei-Siu Payer
(74) *Attorney, Agent, or Firm*—Darby & Darby

(57) ABSTRACT

A food cutting utensil, (e.g., a rotary pizza cutter) includes a disc and a handle that are selectively connectable together. The disc has a first side, a second side and a central through bore that is substantially aligned with an axis of the disc. A rim projects from the first side of the disc about the through bore. The handle has a first portion for being gripped by a hand while being used as a cutting utensil, and a second portion for rotatably supporting the disc. The second portion has a first arm and a second arm. The first arm has an axially projecting hub that is received in the through bore when the handle is connected to the disc.

28 Claims, 3 Drawing Sheets

FIG. 8
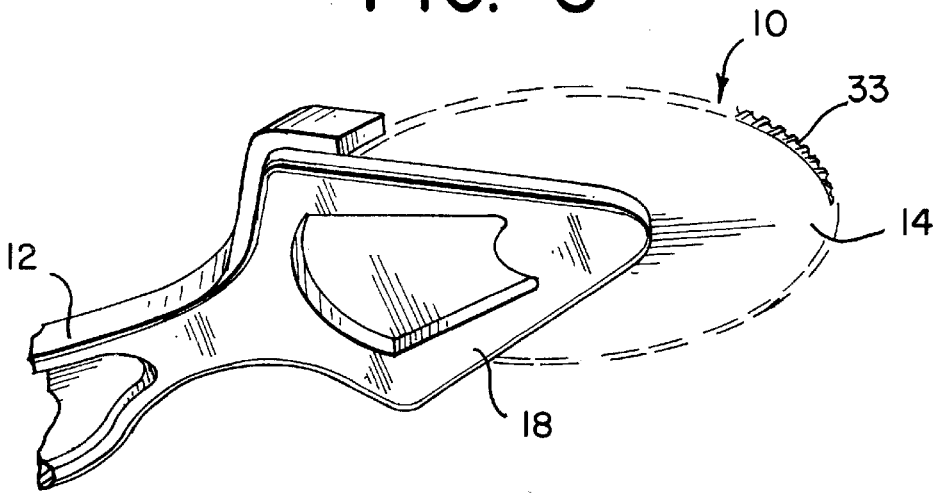
FIG. 9
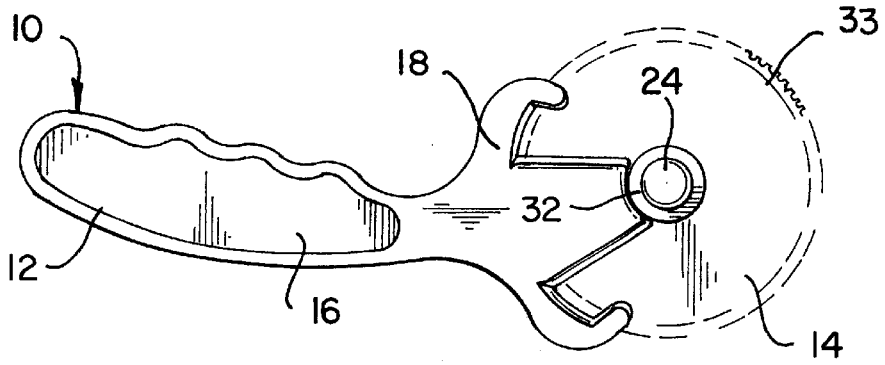
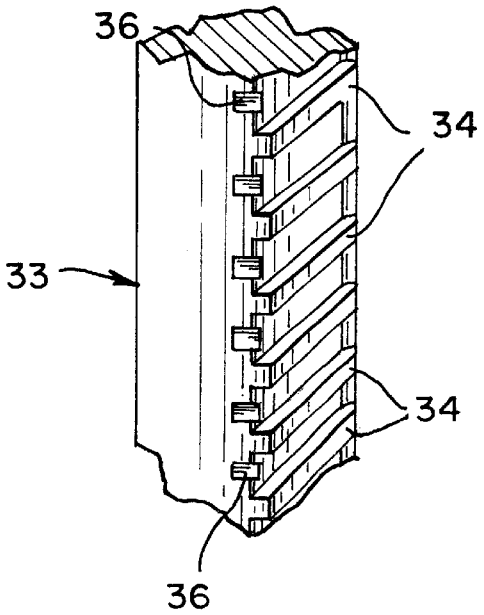
FIG. 10

FOOD CUTTING UTENSIL

BACKGROUND OF THE INVENTION a. Field of the Invention

The present invention relates to a food cutting utensil. More specifically, the present invention relates to a food cutting utensil, such as a rotary pizza cutter, that is formed of a handle and a disc that are selectively snapped together.

b. Discussion of the Related Art

A manual rotary pizza cutter is a well known and common household utensil. These utensils have the cutting disc permanently rotatably connected to a handle, for example, by a rivet connection. However, these relatively expensive, non-disposable tools are not always readily available at every residence, office or place where a pizza is being consumed. Thus, there is a need for an inexpensive, disposable rotary pizza cutter that may be included with each pizza that is delivered to a consumer.

U.S. Pat. No. 5,480,031 to Maultasch et al. discloses a combined pizza box lid support and cutter. In Maultasch's tool, the cutting disc also serves as a "pizza saver", which is used to prevent the lid of the box from contacting a pizza contained within a pizza box. Once the pizza arrives at its destination, the "pizza saver" is removed from the box and a handle is snapped about a shaft of the cutting disc. This connection is relatively insecure, flimsy and is inherently unstable. Thus, during use, the device is ineffective as a cutting utensil because the cutting disc may wobble with respect to the shaft. In some instances, the shaft may separate from the cutting disc. Additionally, while this device is disposable, it is relatively expensive to manufacture because the cutting disc is made unitary with the pizza saver. Further, storing the utensil requires a relatively large amount of room because the pizza saver is rather bulky.

Thus, there is a need in the art for an inexpensive, disposable rotary pizza cutter that has a reliable and secure rotatable connection between the handle and the disc.

There is a further need for a rotary pizza cutter that can be stored in minimal amount of space.

Currently, there are no rotary pizza cutters that satisfy these needs. Accordingly, it is an object of the present invention to provide a food cutting utensil that satisfies these needs.

SUMMARY OF THE INVENTION

A preferred embodiment of the present invention that demonstrates various features, objects and advantages thereof, is directed toward a food cutting utensil that includes a disc and a handle that are selectively connectable together. The disc has a first side, a second side and a central through bore that is substantially aligned with an axis of the disc. A rim projects from the first side of the disc about the through bore. The handle has a first portion for being gripped by a hand while being used as a cutting utensil, and a second portion for rotatably supporting the disc. The second portion has a first arm and a second arm. The first arm has an axially projecting hub that is received in the through bore when the handle is connected to the disc.

In accordance with the present invention, the food cutting utensil is assembled by connecting the disc to the handle by sliding the disc between the first arm and the second arm until the hub is received within the central through bore.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 8 is a partial top perspective view of the assembled disc and handle;

FIG. 9 is a bottom plan view of the assembled disc and handle; and

FIG. 10 is a partial side view of the disc having a first set of serrations and a second set of serrations.

DETAILED DESCRIPTION OF THE PREFERRED EMBODIMENT

Referring now to FIGS. 1–10, a food cutting utensil 10 in accordance with the present invention is illustrated. Utensil 10 includes a handle 12 and a cutting disc 14.

Figure 1:
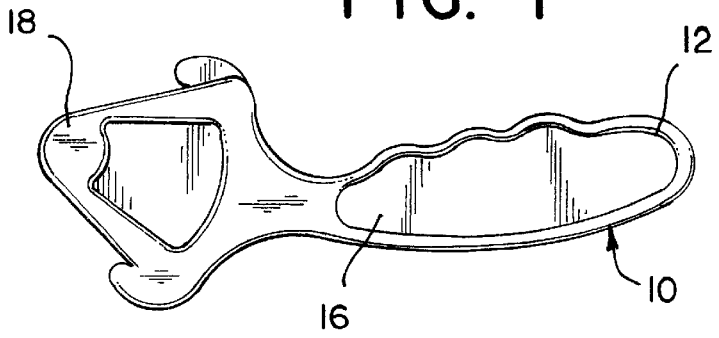
FIG. 1 is a top plan view of a handle of a food cutting utensil according to the present invention.
Figure 2:
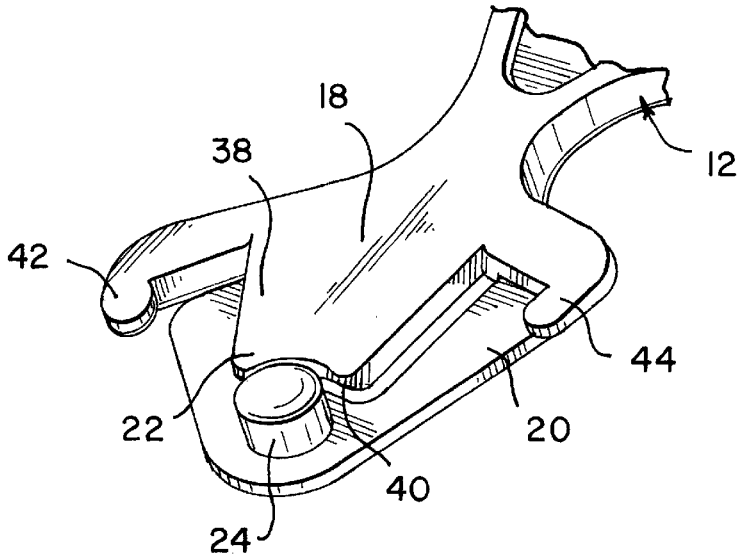
FIG. 2 is a partial bottom perspective view of the disc engaging portion of the handle.
Figure 3:
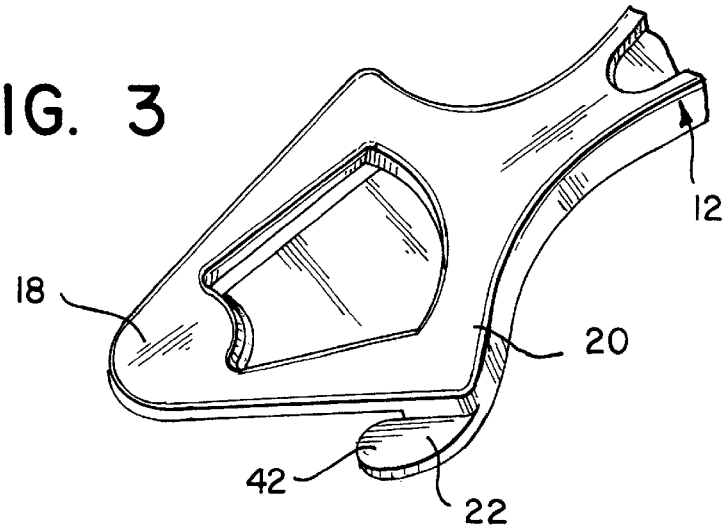
FIG. 3 is a partial top perspective view of the disc engaging portion of the handle.

Referring now to FIGS. 1–3, handle 12 has a first portion 16 that can be gripped by a hand while being used as a cutting utensil. If desired, indicia for advertising can be included on the first portion 16. A second portion 18 of handle 12 rotatably supports disc 14. Second portion 18 has a first arm 20 and a second arm 22. First arm 20 has an axially projecting hub 24. First arm 20, except for hub 24, extends essentially parallel to second arm 22.

Figure 4:
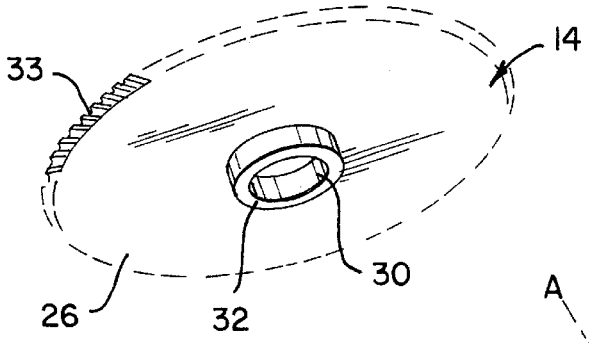
FIG. 4 is a bottom perspective view of the disc.
Figure 5:
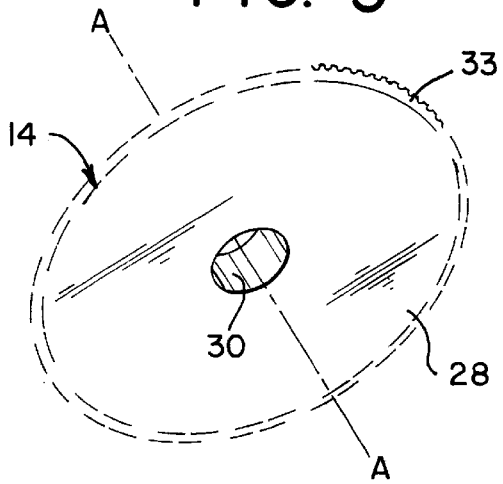
FIG. 5 is a top perspective view of the disc.

Disc 14 has a first side 26, a second side 28 and a central through bore 30 that is approximately aligned with an axis A-A of disc 14. A rim 32 projects from the first side 26 of disc 14 about through bore 30. Disc 14 has a circular perimeter edge 33. As illustrated in FIGS. 4 and 5, edge 33 is serrated. As illustrated in FIG. 10, edge 33 can include a first set of serrations 34 and a second set of serrations 36 that are offset from the first set. Offsetting the serrations has been found to be an effective way to cut and separate a food product, such as pizza.

Second arm 22 of the second portion 18 of handle 12 includes a first central web 38 that has an arcuate free end 40. Arcuate free end 40 provides a bearing supporting surface for rim 32 when disc 14 is connected to handle 12 (see FIGS. 7–9). In this connected position, rim 32 is disposed between hub 24 and the arcuate free end 40. Therefore, hub 24 and arcuate free end 40 provide a rotatable supporting bearing surface for rim 32. An outer surface of each of the rim 32, the hub 24 and the central web 38 are approximately coplanar.

The second arm 22 includes a first finger 42 disposed on one side of said central web 38 and a second finger 44 disposed on a second opposite side of the central web 38. First finger 42 is spaced from central web 38, and second finger 44 is also spaced from central web 38.

Figure 6:
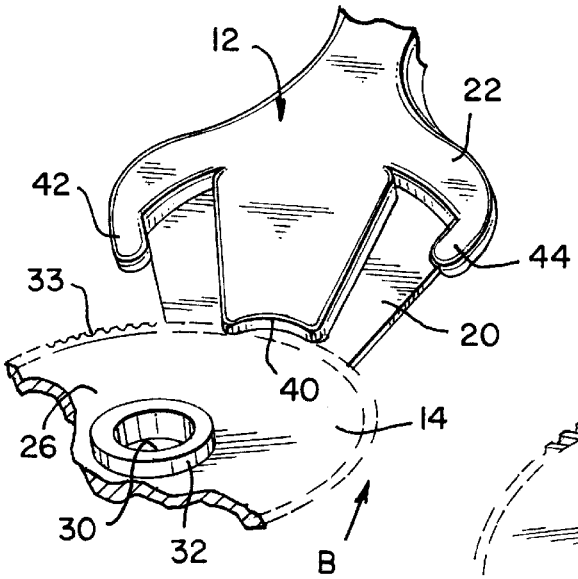
FIG. 6 is a partial bottom perspective view of the disc being inserted into the disc engaging portion of the handle.
Figure 7:
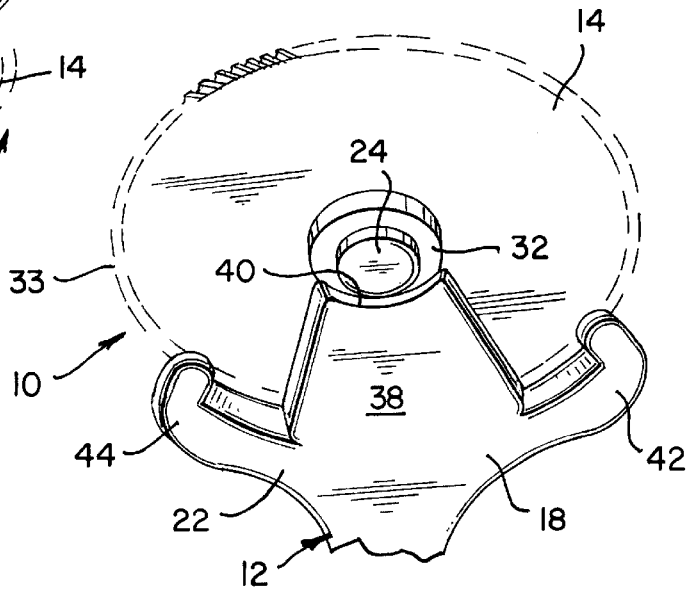
FIG. 7 is a partial bottom perspective view of the assembled disc and handle.

To connect disc 14 to handle 12, the disc 14 is inserted between the first arm 20 and the second arm 22 as illustrated in FIG. 6. Disc 14 is slid in the direction of arrow B until hub 24 snaps into place within central through bore 30 of disc 14, as illustrated in FIGS. 7–9. In this connected position, each of the first finger 42, the second finger 44 and the central web 38 support the first side 26 of disc 14. Because fingers 42, 44 are spaced from central web 38, disc 14 rotates stably about hub 24. Thus, in the connected position, the second arm 22 rotatably supports the first side 26 of disc 14, and the first arm 20 rotatably supports the second side 28 of disc 14.

Having described the presently preferred exemplary embodiment of a food cutting utensil in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A food cutting utensil comprising:

a disc having a first side, a second side and a central through bore that is substantially aligned with an axis of said disc, a rim projecting from said first side about said through bore; and a handle having a first portion for being gripped by a hand while being used as a cutting utensil, and a second portion for rotatably supporting said disc, said second portion having a first arm and a second arm, said first arm having an axially projecting hub;

wherein said disc is selectively connectable with said handle, in a connected position said hub being received within said central through bore.

2. The utensil according to claim 1, wherein said first arm, except for said hub, extends essentially parallel to said second arm.

3. The utensil according to claim 2, wherein, in said connected position, said first arm supports said second side of said disc.

4. The utensil according to claim 3, wherein, in said connected position, said second arm supports said firs t side of said disc.

5. The utensil according to claim 2, wherein, in said connected position, said second arm supports said first side of said disc.

6. A utensil according to claim 5, wherein, in said connected position, said second arm includes a first central web having an arcuate free end for providing a bearing supporting surface for said rim.

7. The utensil according to claim 6, wherein, in said connected position, said rim is disposed between said hub and said arcuate free end of said central web of said second arm.

8. The utensil according to claim 7, wherein, in said connected position, an outer surface of each of said rim, said hub and said central web are approximately coplanar.

9. The utensil according to claim 6, wherein said second arm includes a first finger disposed on a first side of said central web and a second finger disposed on a second opposite side of said central web, in said connected position, each of said first finger, said second finger and said central web supporting said first side of said disc.

10. The utensil according to claim 9, wherein said first finger is spaced from said central web.

11. The utensil according to claim 10, wherein said second finger is spaced from said central web.

12. The utensil according to claim 1, wherein said disc has a circular perimeter edge.

13. The utensil according to claim 12, wherein said circular edge is serrated.

14. The utensil according to claim 13, wherein said serrated circular edge includes a first set of serrations and a second set of serrations offset from said first set.

15. A food cutting utensil comprising:

a disc having a first side, a second side and a central through bore that is substantially aligned with an axis of said disc, a rim projecting from said first side about said through bore; and a handle having a first portion for being gripped by a hand while being used as a cutting utensil, and a second portion for rotatably supporting said disc, said second portion having a first arm and a second arm, said second arm including a first central web having an arcuate free end;

wherein said disc is selectively connectable with said handle, in a connected position, said arcuate free end providing a bearing supporting surface for said rim.

16. The utensil according to claim 15, wherein said first arm has an axially projecting hub, in said connected position, said rim is disposed between said hub and said arcuate free end of said central web of said second arm.

17. The utensil according to claim 16, wherein, in said connected position, an outer surface of each of said rim, said hub and said central web are approximately coplanar.

18. The utensil according to claim 15, wherein said second arm includes a first finger disposed on a first side of said central web and a second finger disposed on a second opposite side of said central web, in said connected position, each of said first finger, said second finger and said central web supporting said first side of said disc.

19. The utensil according to claim 18, wherein said first finger is spaced from said central web.

20. The utensil according to claim 19, wherein said second finger is spaced from said central web.

21. A food cutting utensil comprising:

a disc having a first side, a second side and a central through bore that is substantially aligned with an axis of said disc, a rim projecting from said first side about said through bore; and a handle being selectively connectable with said disc, said handle, having a first portion for being gripped by a hand while being used as a cutting utensil, and a second portion for rotatably supporting said disc, said second portion having a first arm and a second arm, said first arm has an axially projecting hub, in a connected position, said hub is disposed radially inwardly with respect to an arcuate free end of a central web of said second arm.

22. The utensil according to claim 21, wherein, in said connected position, said arcuate free end providing a bearing supporting surface for said rim.

23. The utensil according to claim 22, wherein, in said connected position, said rim is disposed between said hub and said arcuate free end of said central web of said second arm.

24. The utensil according to claim 23, wherein, in said connected position, an outer surface of each of said rim, said hub and said central web are approximately coplanar.

25. The utensil according to claim 22, wherein said second arm includes a first finger disposed on a first side of said central web and a second finger disposed on a second opposite side of said central web, in said connected position, each of said first finger, said second finger and said central web supporting said first side of said disc.

26. The utensil according to claim 25, wherein said first finger is spaced from said central web.

27. The utensil according to claim 26, wherein said second finger is spaced from said central web.

28. A method of assembling a food cutting utensil, said utensil comprising a disc having a first side, a second side and a central through bore that is substantially aligned with an axis of said disc, a rim projecting from said first side about said through bore; and a handle having a first portion for being gripped by a hand while being used as a cutting utensil, and a second portion for rotatably supporting said disc, said second portion having a first arm and a second arm, said first arm having an axially projecting hub; said method comprising the steps of:

connecting said disc to said handle by sliding said disc between said first arm and said second arm until said hub is received within said central through bore.

* * * * *